US005340156A

United States Patent [19]

Bianco

[11] Patent Number: 5,340,156

[45] Date of Patent: Aug. 23, 1994

[54] NOTEBOOK BINDER HAVING A TRAY WITH SLIDING LID

[75] Inventor: Ronald M. Bianco, Irvine, Calif.

[73] Assignee: Day Runner, Inc., Fullerton, Calif.

[21] Appl. No.: 196,600

[22] Filed: Feb. 9, 1994

[51] Int. Cl.[5] ..... B42F 3/00

[52] U.S. Cl. ..... 281/37; 281/31; 281/29; 402/70

[58] Field of Search ..... 281/29, 31, 37, 51; 402/70, 73, 80 R, 502; 206/472

[56] References Cited

U.S. PATENT DOCUMENTS

| | | | |
|---|---|---|---|
| D. 290,375 | 6/1987 | Nava . | |
| D. 317,977 | 7/1991 | Felkner et al. . | |
| 434,040 | 8/1890 | Andrews . | |
| 501,508 | 7/1893 | Hays . | |
| 870,771 | 11/1907 | Garman . | |
| 1,585,846 | 5/1926 | Frisbie | 281/37 |
| 4,306,737 | 12/1981 | Errichiello . | |
| 4,630,843 | 12/1986 | Willat . | |
| 4,765,462 | 8/1988 | Rose, Jr. . | |
| 4,832,191 | 5/1989 | Gerver et al. . | |
| 4,966,283 | 10/1990 | Sykes et al. . | |
| 5,058,736 | 10/1991 | Bedol . | |
| 5,150,792 | 9/1992 | Munroe . | |
| 5,277,452 | 1/1994 | Skidmore | 281/31 |

FOREIGN PATENT DOCUMENTS

| | | | |
|---|---|---|---|
| 2749854 | 5/1979 | Fed. Rep. of Germany | 281/31 |

*Primary Examiner*—Mark Rosenbaum
*Assistant Examiner*—Willmon Fridie, Jr.
*Attorney, Agent, or Firm*—Pretty, Schroeder, Brueggemann & Clark

[57] ABSTRACT

A notebook binder having a binder cover, a tray and a tray lid. The tray is fixed to the binder cover and has a peripheral ridge that defines a tray opening for receiving articles. The tray lid includes a first portion that forms a flat working surface and a second portion in sliding engagement with the tray between a closed position wherein the tray lid covers the tray opening and an extended position wherein the tray lid is adjacent the tray opening with the tray opening uncovered. The tray lid further includes a support ridge projecting below the flat working surface to support the flat working surface in a substantially level orientation relative to the binder cover when the tray lid is in the extended position.

20 Claims, 7 Drawing Sheets

FIG. 1
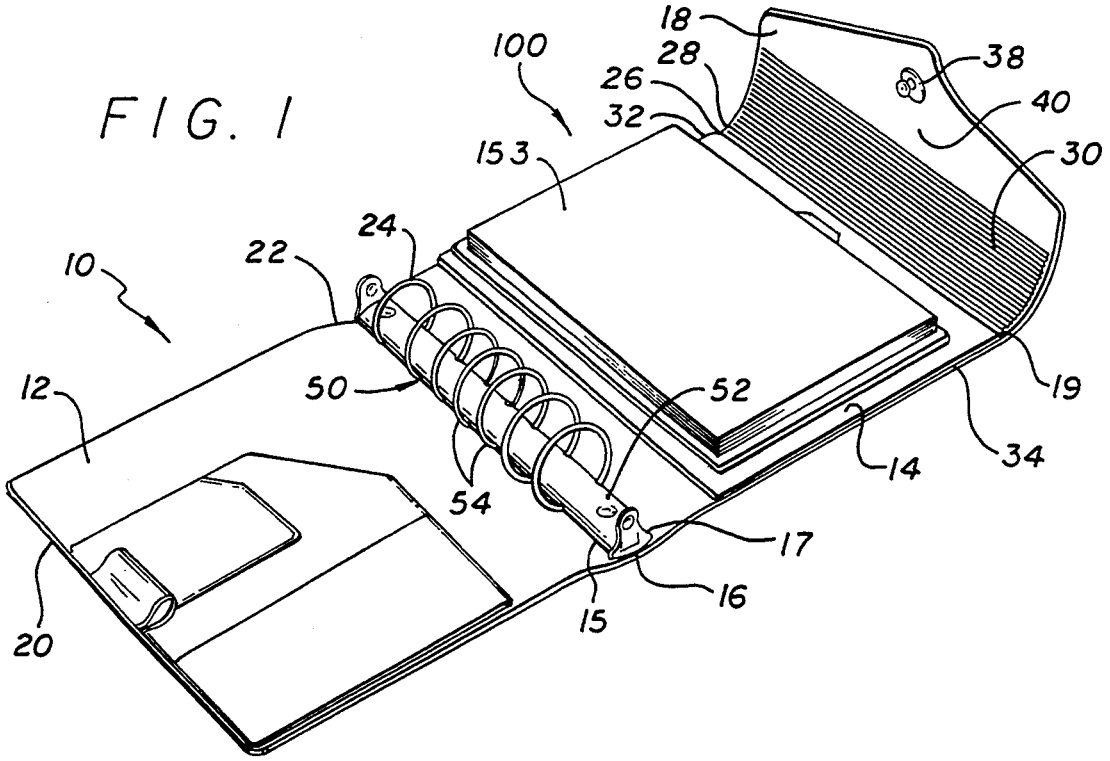
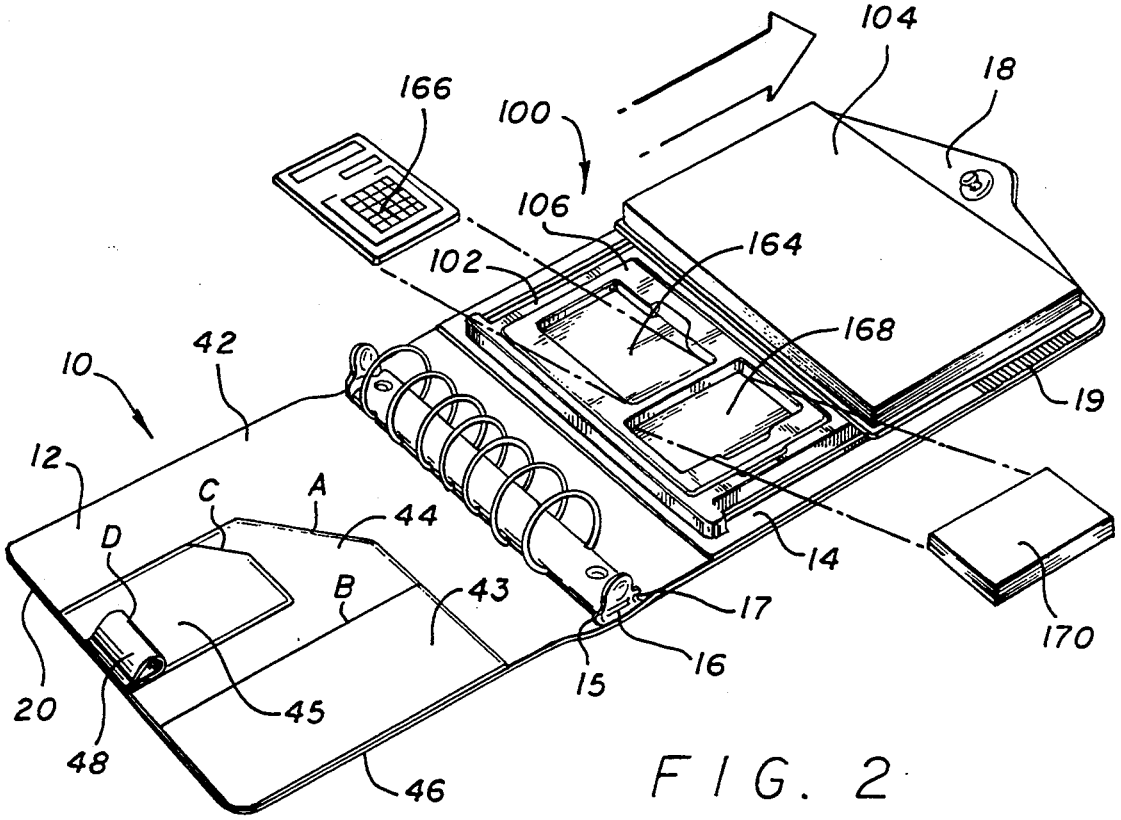
FIG. 2

FIG. 12
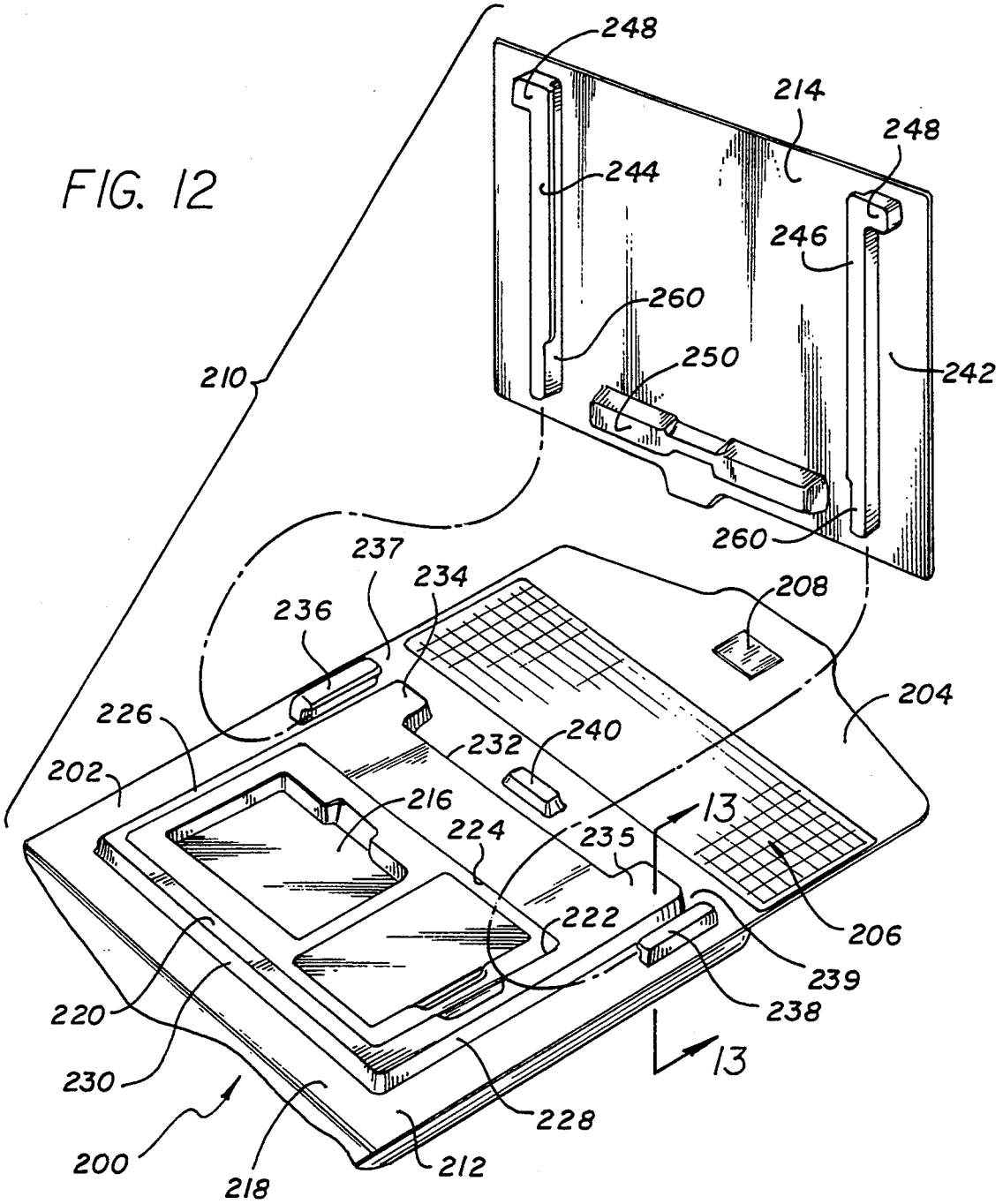
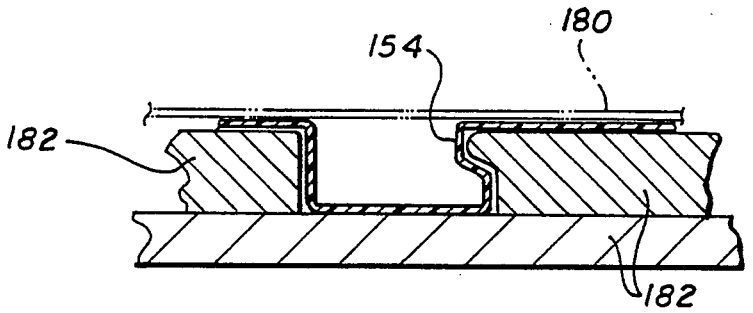
FIG. 13

NOTEBOOK BINDER HAVING A TRAY WITH SLIDING LID

BACKGROUND OF THE INVENTION

This invention relates generally to notebook binders, and, more particularly, to notebook binders having trays for storing and retaining articles, such as calculators or other electronic devices, to-do lists, checklists, self-stick removable notes, and the like, that are used to supplement, or are used in conjunction with, information contained within the binder.

In today's mobile society, frequent business travelers, and travelers in general, are relying more and more on notebook binders for organizing their day-to-day activities. Notebook binders are expected to be as compact as possible, yet contain all the necessary information as well as include all the basic utensils and instruments for writing and calculating that would otherwise be readily available at the user's home or office. Optimally, the notebook binder serves as the user's briefcase and desk and, with the advent of mini-computers, cellular telephones and portable facsimile machines, may serve as a mobile office.

Present notebook binders include boxes, pockets, holders and/or inserts of various types for holding a variety of articles. For example, U.S. Pat. No. 4,306,737 to Errichiello describes a looseleaf notebook wherein the inner face of the front cover has a shallow, rectangular cavity for receiving items such as instructions, labels, decals, cards, etc. The notebook binder may also include snap-on pockets for holding a variety of articles and pairs of snap-in ribs to hold pencils, rulers, etc. U.S. Pat. No. 5,058,736 to Bedol describes a notebook organizer having a center compartment for holding articles, such as a calculator, pencil sharpener and coin holder, and two side compartments having pivoting lids. U.S. Pat. No. 4,765,462 to Rose Jr. describes a notebook having a storage receptacle for floppy disks or diskettes and loose leaf documentation associated with the disks. The storage receptacle is made of thermoformed polypropylene plastic. U.S. Pat. No. 434,040 to Andrews describes a portable writing desk having a receptacle with a sliding cover. The cover may be provided with a writing pad.

The notebooks and portable writing desks described above function generally satisfactorily to store and retain articles. However, they nevertheless have certain disadvantages. In particular, previous notebooks that have been adapted to include receptacles for retaining and storing articles have been unwieldy. Writing in such notebooks was often rendered difficult because the paper or writing pad was not adequately supported to provide a flat, stable writing surface. In addition, excessive manipulation of the writing surface was often required to both access a particular compartment, pocket or holder to retrieve a selected article or instrument and then to replace the writing surface, before further writing could be continued. Further drawbacks of previously used notebok binders having storage receptacles are that they were relatively difficult to manufacture and assemble and difficult to use.

It should therefore be appreciated that there is still a need for a compact notebook binder that includes a tray having a stable writing surface. The tray should also be easy to make, assemble and use.

SUMMARY OF THE INVENTION

The present invention is embodied in a compact notebook binder that includes a tray having a sliding lid that acts as a writing surface. The lid is constructed to provide a flat, stable working surface whether covering the tray or not. The tray and lid are easy to manufacture and assemble and easy to use. The tray opening is suitable for receiving interchangeable, form fitting, tray inserts, each insert having a depressed region or regions for securely retaining a different article or combination of articles.

The notebook binder of the present invention includes a binder cover and a tray fixed to the cover. The tray includes a peripheral ridge projecting above the cover defining a tray opening for receiving articles. A tray lid is slidably connected to the tray for permitting movement of the tray lid between a closed position wherein the tray lid covers the tray opening and an extended position wherein the tray lid is adjacent the tray opening with the tray opening uncovered. The tray lid includes a first portion forming a flat working surface and a second portion forming a support ridge projecting below the flat working surface. The support ridge has a depth below the flat working surface sufficient to support the flat working surface in a stable manner by the support ridge in a substantially level orientation when the tray lid is in the extended position.

A feature of the present invention is that the peripheral ridge has a first outer wall facing away from the tray opening and a second outer wall facing away from the tray opening in a direction opposite to that of the first outer wall. The tray lid includes first and second laterally extending ridges that project below the flat working surface of the lid and are configured to oppose the first and second outer walls, respectively, such that the tray lid is laterally slidable along the first and second outer walls between the first and second positions. A cross ridge projecting below the flat working surface may be disposed between the first and second laterally extending ridges to act as the support ridge.

Another feature of the present invention is that the tray is formed in a first single sheet of plastic material and the first laterally extending ridge, the second laterally extending ridge and the cross ridge are formed in a second single sheet of plastic material. Such sheets, preferably formed by vacuforming, are easy to manufacture and assemble and are relatively inexpensive.

A further feature of the present invention is a tray insert formed in a third single sheet of plastic material. The tray insert includes an outer periphery configured to be closely received within the tray opening and defines at least one depressed region for receiving and retaining a selected article.

In a preferred embodiment, the first outer wall of the peripheral ridge has a laterally extending projected portion that overlaps an opposed laterally extended projected portion of the first laterally extending ridge of the lid. Similarly, the second outer wall of the peripheral ridge has a laterally extending projected portion that overlaps an opposed laterally extending projected portion of the second laterally extending ridge of the lid. This permits the lid to be firmly guided in a lateral direction and provides solid interlock to resist vertical separation of the lid from the tray.

A further feature of the present invention is that the tray may be provided with rod holding portions and support rods for engaging the tray lid to prevent the tray lid from being lifted apart from the tray. The tray may also be provided with raised stops to prevent the tray lid from being slid apart from the tray. Additionally, the lid may include a pocket for inserting a flat styrene member to provide a hard surface for writing and a tab to facilitate movement of the lid.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

FIG. 1 is a perspective view of a notebook binder with a tray and tray lid according to the present invention, showing the tray lid in a closed position, FIG. 2 is a perspective view of the notebook binder in FIG. 1, showing the tray lid in an open position and showing an insert for holding a calculator and notepad in the tray opening.

FIG. 12 is an exploded view of an alternative embodiment of the notebook binder of the present invention.

FIG. 13 is a sectional view showing the forming of a portion of the tray.

DETAILED DESCRIPTION OF THE PREFERRED EMBODIMENTS

Figure 3:
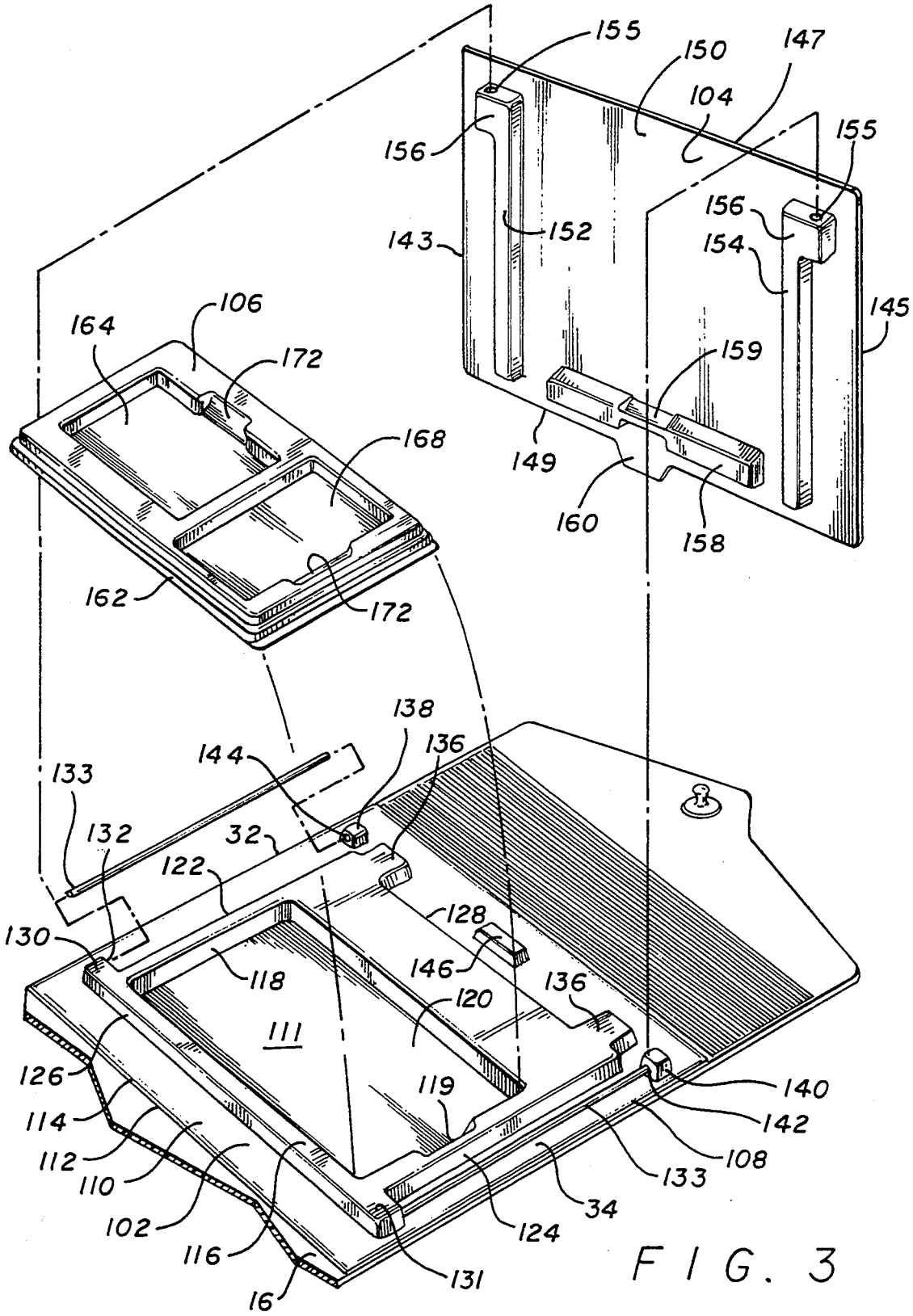
FIG. 3 is an exploded view of the tray/lid combination of the notebook binder in FIG. 1.

A notebook binder 10 having a tray/lid combination 100 embodying the features of the present invention is shown in FIGS. 1-2. The binder 10 includes a front cover 12, a back cover 14, a spine 16 and a flexible closure panel 18, all interconnected by three hinge connections 15, 17, 19.

The front cover 12 includes a free end 20 and a hinged end 22 connected by hinge connection 15 to the spine 16. The front cover may be made of a conventional fabric, vinyl or leather covered cardboard construction defining an essentially square plan view. A cardboard insert (not shown) for providing stiffness does not extend into the hinge connection. In some embodiments, where a pliable cover is desired, the cardboard insert may be omitted. Similarly, the back cover 14 has a first end 24 connected by hinge connection 17 to the spine. The back cover 14 may be constructed in identical manner to the front cover 12, having the same material construction and essentially the same dimensions. Opposite the hinge connection 17 to the spine, the back cover has, along a second end 26, the last hinge connection 19, which is also connected to a hinged end 28 of the flexible closure panel 18.

The hinged end 28 includes an articulated portion 30 that is not reinforced. The articulated portion is formed of a plurality of depressed rows of material extending from a top edge 32 of the notebook binder to a bottom edge 34 of the notebook binder, permitting the closure panel to be folded onto an outside surface of the front cover 12 when the binder is closed. A fastener 38 located on an inside surface 40 of the closure panel provides a releasable connection to a fastener receiver (not shown) on the outside surface of the front cover.

Pockets may be provided on an inside surface 42 of the front cover 12. Pocket A is formed by affixing, for example by stitching or heat sealing, a piece of material 44 along the free end 20 and a bottom edge 46 of the front cover. Pockets B and C are similarly provided by affixing additional pieces of material 43, 45, respectively, to the piece of material 44. A pen holder D may be provided by a piece of looped material 48 fastened along the free end of the front cover.

The notebook binder 10 also includes a ring assembly 50, or document retention mechanism, having a support member 52 secured to the spine 16 and a plurality of snap rings 54. Each snap ring 54 is formed of two arcuate portions which snap together at a juncture. Opening the rings 54 by spreading the two portions at the juncture allows for insertion or removal of looseleaf documentation.

Figure 4:
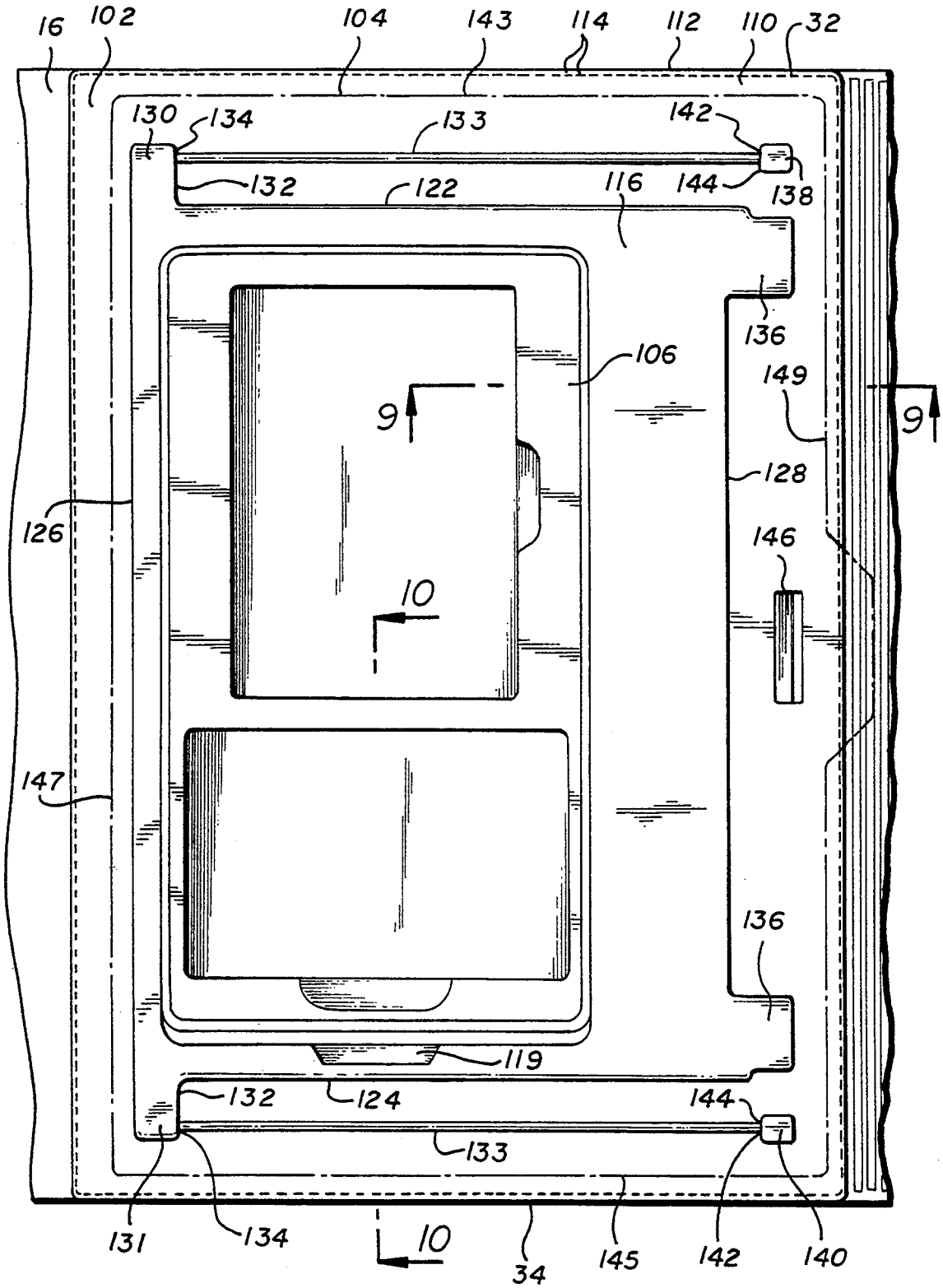
FIG. 4 is a plan view of the tray of the notebook binder in FIG. 1, showing the lid in phantom in the closed position.

With particular reference now to FIGS. 3 and 4, the tray/lid combination 100 includes a tray 102, a tray lid 104 and a tray insert 106, each preferably made from a single sheet of vacuformed plastic material such as a 0.040 inch thick sheet of ABS-PVC. The tray/lid combination is preferably mounted to a flat inside surface 108 of the back cover 14 of the notebook binder.

The tray 102 includes a flat backing portion 110 having a peripheral edge 112 that substantially matches the peripheral configuration of the inside surface of the back cover. The flat backing portion 110 may be connected to the inside surface of the back cover by stitching 114 around the peripheral edge 112 or by other means such as gluing or heat sealing. Inwardly from the peripheral edge 112, the tray further defines an upwardly extending peripheral ridge 116 having an inner wall 118 defining a tray opening 120. The inner wall extends upwardly, perpendicular to a flat base portion 111 that forms the bottom of the tray opening. At a lower end of the tray opening, the inner wall is flared and slanted along an access portion 119 to permit a user to readily pull out the insert 106 placed inside the tray opening. The tray opening 120 and the insert 106 are shogun having a rectangular shape, but any desired shape may be used.

The peripheral ridge 116 of the tray 102 further defines a first outer wall 122 facing away from the tray opening 120 and towards the top edge 32 of the notebook binder, a second outer wall 124 facing away from the tray opening and towards the bottom edge 34 of the notebook binder, a first sidewall 126 facing away from the tray opening and towards the spine 16 and a second sidewall 127 facing away from the tray opening and away from the spine. Preferably, the first and second outer walls are parallel to each other with the sidewalls perpendicularly arranged therebetween.

The peripheral ridge 116 includes a first rod holder 130 raised above the flat backing portion of the tray and extending outwardly from the first outer wall 122 adjacent the spine. Similarly, the peripheral ridge includes a second rod holder 131 raised above the flat backing portion of the tray and extending outwardly from the second outer wall 124 adjacent the spine. Each rod holder has a wall 132 facing away from the spine for receiving an end of a rod 133 through an opening 134 defined therein. The peripheral ridge further includes retaining portions 136 raised above the flat backing portion 110 and extending outwardly from each end of the second sidewall 128. The height of the peripheral ridge above the flat backing portion, including the height of the rod holders and retaining portions is preferably kept constant.

The tray further defines a first raised top 138 and a second raised stop 140. The first and second stops are associated with the first rod holder 130 and the second rod holder 131 of the peripheral ridge, respectively. The stops each have a wall 142 defining an opening 144 for receiving the other end of rods 133. The tray also defines a detent 146 raised above the flat backing portion and disposed adjacent the second sidewall 128 between the retaining portions 136.

Figure 11:
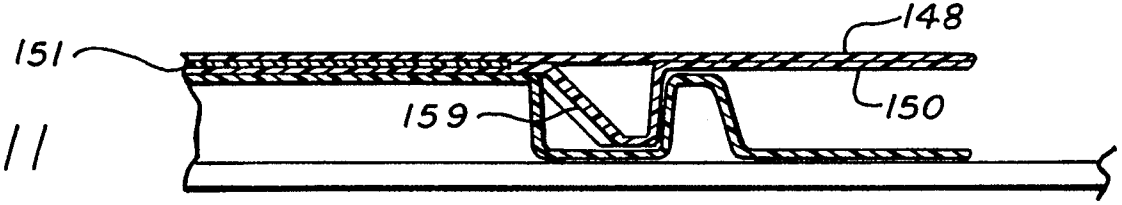
FIG. 11 is a sectional view of the notebook binder of the present invention, taken along line 11—11 of FIG. 4.

The tray lid 104 includes an outer covering 148, an inner backing portion 150 and a flat rigid insert 151 (see FIG. 11). The inner backing portion is preferably a plastic sheet of vacuformed material having an upper edge 143, a lower edge 145, an inside edge 147 and an outside edge 149. The outer covering is fastened to the inner backing portion along three edges, e.g., by stitching or heat sealing. The unfastened fourth edge provides a pocket for inserting the flat rigid insert 146. The insert may be made of styrene or other suitable material that provides a hard surface for writing upon. A notepad 153 may also be secured to the pocket (see FIG. 1).

Projecting below the inner backing portion 150 of the tray lid are first and second laterally extending ridges 152, 154. The laterally extending ridges are generally parallel to each other and are spaced apart from each other such that when the tray lid is placed on the tray, the first laterally extending ridge 152 is aligned with and in opposed relationship to the first outer wall 122 of the tray and the second laterally extending ridge 154 is aligned with and in opposed relationship to the second outer wall 124 of the tray. Each laterally extending ridge has an abutment 156 extending outwardly from the laterally extending ridge adjacent the inside edge 147 of the inner backing portion 150. The abutments have openings 155 therethrough for receiving the rods 133.

A cross ridge 158 also projects below the inner backing portion 150 between the laterally extending ridges 152, 154. The cross ridge is located adjacent and parallel to the outside edge 149 of the inner backing portion. Preferably the cross ridge is further positioned on the inner backing surface such that when the tray lid and tray are assembled, the cross ridge will be disposed between the retaining portions 136 of the tray. The cross ridge may also be configured to contact the second sidewall 128 of the tray when the tray lid completely covers the tray opening, preventing further inward movement of the tray lid.

Preferably, the depth of the laterally extending ridges 152, 154 and the cross ridge 158 below the inner backing portion 150 of the tray lid is substantially equal to the height of the peripheral ridge 116 above the flat backing portion 110 of the tray such that, when the tray lid is attached to the tray, the tray lid is supported on the back cover and on the flexible closure panel of the binder by the laterally extending ridges and the cross ridge. Such support stabilizes the tray lid, permitting a user to write on the tray lid whether the tray lid is closed (FIG. 1) or open (FIG. 2).

The cross ridge 158 of the inner backing surface also defines a cam surface 159 for cooperatively engaging the detent 146 of the tray (see FIG. 11). The outside edge 149 of the inner backing portion of the tray lid defines a tab 160 to permit a user to readily slide the tray lid with respect to the tray.

With reference to FIGS. 2 and 3, the tray insert 106 has an outer periphery 162 configured to be closely received within the tray opening 120 of the tray. The tray insert defines a first depressed region 164 for receiving an article, such as a calculator 166, and a second depressed region 168 to receive another article, such as a self stick notepad 170 (see FIG. 2). Each depressed region includes a slanted access portion 172 to permit a user to remove or replace articles. In the preferred embodiment, numerous interchangeable form fitting inserts (not shown) may be made available having various arrangements for the location and size of the depressed regions for securely retaining various sized articles, as desired by the user.

To assemble the tray/lid combination 100, the rods 133 are inserted through the openings 155 of the abutments 156 of the tray lid. One end of the rods is then inserted through the openings 134 in the walls 132 of the first and second rod holders 130, 131 and the other end of the rods is inserted through the openings 144 in the first and second raised stops 138, 140.

Figure 5:
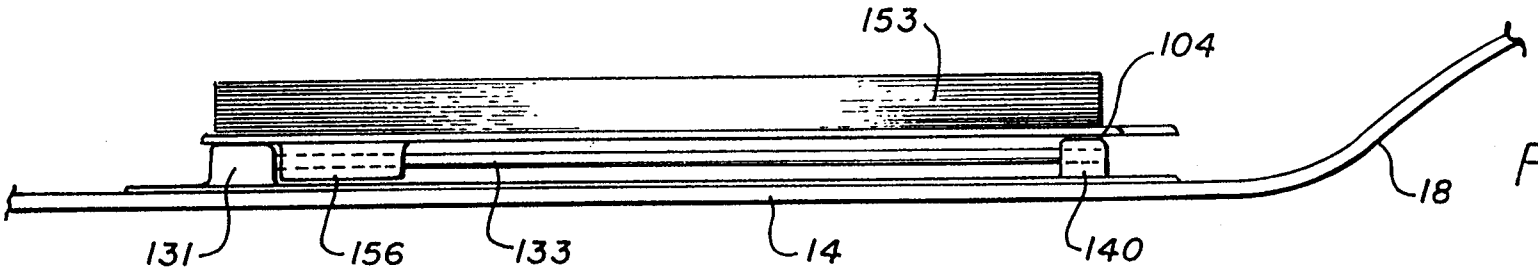
FIG. 5 is an end view of the tray/lid combination of the notebook binder in FIG. 1, showing the lid in the closed position.
Figure 6:
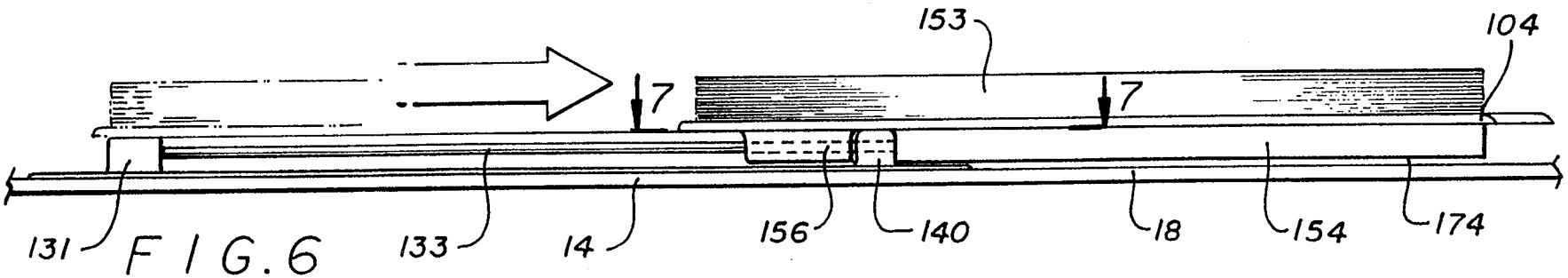
FIG. 6 is an end view of the tray/lid combination of the notebook binder in FIG. 2, showing the lid in the open position.
Figure 7:
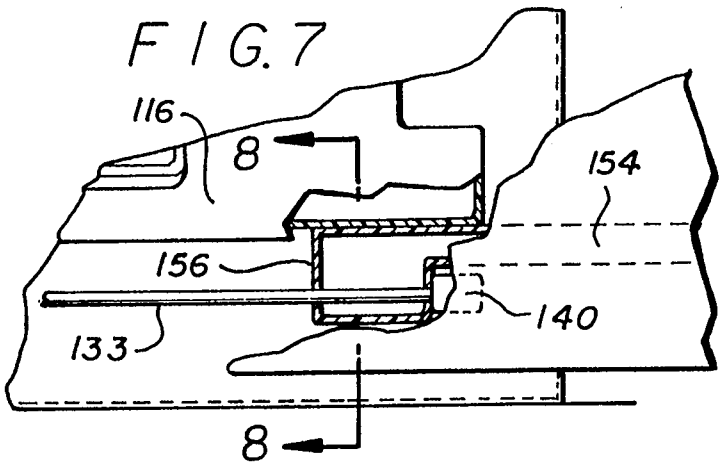
FIG. 7 is a partial plan view, partially in section, of the tray/lid combination of the notebook binder of the present invention, taken along line 7—7 of FIG. 6.

With reference to FIGS. 5–7, the tray lid 104 is slidable between a closed position, wherein the tray opening is covered and the abutment 156 of the second laterally extending ridge 154 is disposed against the second rod holder 131 of the peripheral ridge 116 of the tray, and an open position, wherein the tray opening is exposed and the abutment 156 is disposed against the second raised stop 140. The spatial relationship of the abutment of the tray lid, and the rod holder and the raised stop of the tray is arranged to prevent the tray lid from being separated from the tray when it is slid to the extended position and to prevent the tray lid from interfering with the ring assembly 50 when slid to the closed position. Additionally, the rods 133 secure the tray lid to the tray so that the tray lid cannot be lifted apart from the tray.

When the tray lid is in the closed position, the tray lid protects the articles disposed in the tray insert from damage. Articles, such as calculators, or other electronic devices, are further protected from damage due to accidental bumps or jolts due to their secure placement within the form fitting depressed regions of the insert, which, in turn, is form fit within the tray opening. In the open position, the tray lid exposes the tray insert so that the articles may be accessed.

A feature of the tray/lid combination is that in the open position (FIG. 6), the laterally extending ridges 152, 154 and the cross ridge 158 of the tray lid have bearing surfaces 174 that serve to support the tray lid on the back cover 14 and on the flexible closure panel 18 of the binder. This simultaneously provides a stable surface for writing on the notepad 153 and ready access to the tray insert 106 (see FIG. 2).

Figure 8:
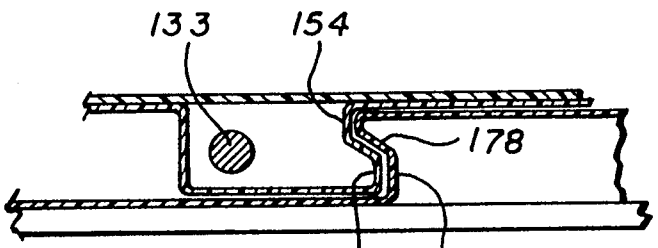
FIG. 8 is a sectional view of the notebook binder of the present invention, taken along line 8—8 of FIG. 7.

To further stabilize the tray lid with respect to the tray, the laterally extending ridges 152, 154 of the tray lid may be provided with laterally extending, lower projected portions 176 that interlock with corresponding, laterally extending, upper projected portions 178 of the first and second outer walls 122, 124 of the peripheral ridge 116 of the tray (see FIG. 8). The projected portions of the laterally extending ridges and the outer walls are preferably formed during the manufacture of the tray and of the inner backing portion of the tray lid, as more fully described below.

In the preferred embodiment, the tray 102, the inner backing portion 150 of the tray lid 104 and the tray insert 106 are each made from a single sheet of vacuformed plastic material. With reference to FIG. 13, a relatively stiff self-supporting plastic tray sheet 180 is positioned horizontally as shown by dotted lines above a molding form or die 182. The tray sheet is then heated uniformly to render if thermodeformable. Vacuum ports (not shown) are provided to draw the soft, hot, plastic against the molding form, thereby conforming the plastic precisely to the inside contour of the molding form. The formed sheet of plastic material is then removed from the mold. It will be appreciated by those skilled in the art that when molding a sheet of material having projected portions, such as the projected portion 154 on each laterally extending ridge of the tray lid and the projected portions on the first and second outer walls of the peripheral ridge of the tray, it may be difficult to separate the sheet of material from the mold because the projected portion will interfere with the mold due to the undercut in the mold. This problem may be solved, however, by removing the sheet of plastic material from the mold before it has fully cooled, such that the sheet of material will resiliently deflect or bend.

Figure 9:
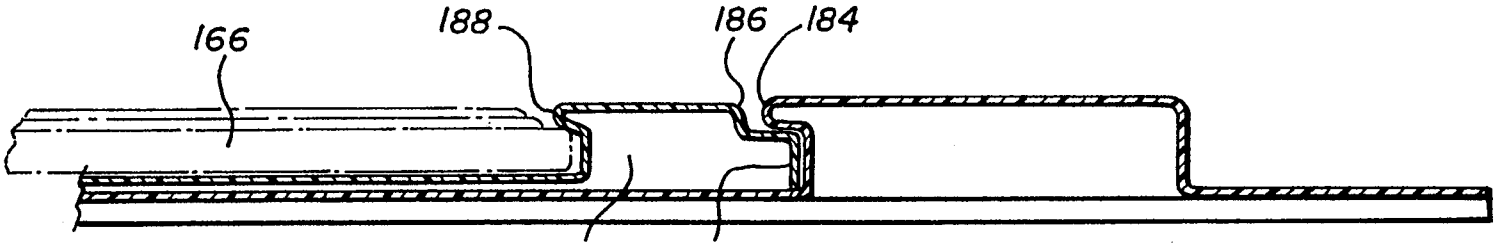
FIG. 9 is a sectional view of the notebook binder of the present invention, taken along line 9—9 of FIG. 4.
Figure 10:
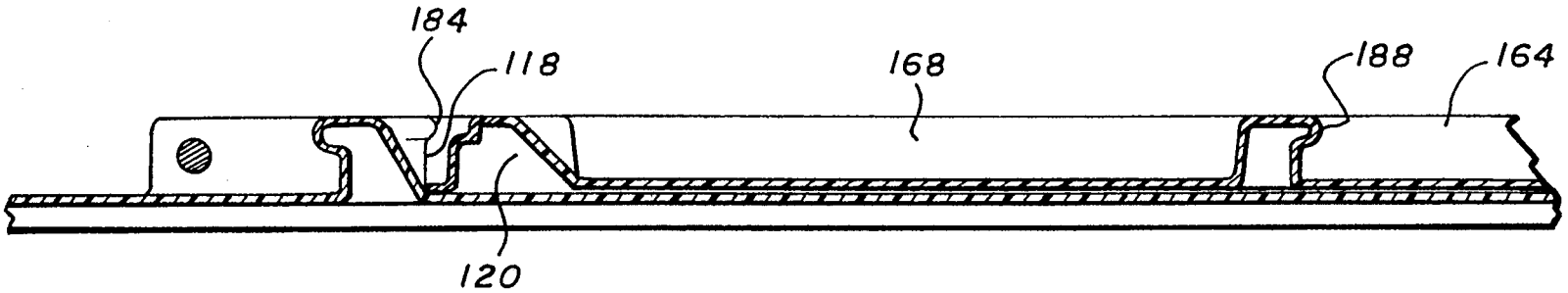
FIG. 10 is a sectional view of the notebook binder of the present invention, taken along line 10—10 of FIG. 4.

With reference to FIGS. 9 and 10, the inner wall 118 of the tray defining the tray opening 120 may be provided with a peripheral boss 184 around the tray opening. The peripheral boss may be formed by the molding process described above. The peripheral boss cooperates with a peripheral shoulder portion 186 formed on the tray insert 106 such that the insert may be tightly secured within the tray opening. Similarly, the tray opening may be provided with a peripheral boss 188 around the depressed regions 164, 168 for more securely retaining the articles, such as the calculator 166, therein.

With reference to FIG. 12, an alternative embodiment of a notebook binder 200 according to the present invention is shown. The binder 200 includes a front cover (not shown), a back cover 202 and a flexible closure panel 204. In this case, the flexible closure panel has an articulated portion that is formed from a plurality of square depressed regions 206, permitting the closure panel to be folded onto an outside surface of the front cover when the binder is closed. A hook and loop fastener 208 may be used to fasten the flexible closure panel to the front cover.

As with the first embodiment, the embodiment shown in FIG. 12 includes a tray/lid combination 210 having a tray 212, a tray lid 214, and a tray insert 216, each preferably made from a single sheet of vacuformed plastic material. The tray/lid combination is mounted to the back cover of the notebook binder.

The tray 212 includes a flat backing portion 218 that defines an upwardly extending peripheral ridge 220 having an inner wall 222 that defines a tray opening 224. The peripheral ridge of the tray further defines a first outer wall 226 facing away from the tray opening towards the top edge of the notebook binder, a second outer wall 228 facing away from the tray opening and towards the bottom edge of the notebook binder, a first sidewall 230 facing away from the tray opening towards the spine and a second sidewall 232 facing away from the tray opening and away from the spine. The first and second outer walls are parallel to each with the sidewalls perpendicularly arranged therebetween. The peripheral ridge further defines upper and lower retaining portions 234, 235 that extend outwardly from each end of the second sidewall 232. The height of the peripheral ridge, above the flat backing portion, is preferably kept constant.

The flat backing portion 218 further defines a first raised stop 236 that is spaced from and disposed parallel to the first outer wall 226 to form a first track 237 therebetween and a second raised stop 238 that is spaced from and disposed parallel to the second outer wall 228 to form a second track 239 therebetween. The flat backing portion further defines a raised detent 240 disposed adjacent the second sidewall 232 between the retaining portions of the peripheral ridge.

The tray lid 214 includes an outer covering (not shown), an inner backing portion 242 and a flat rigid insert (not shown). As with the first embodiment, the insert is disposed in a pocket between the outer covering and the inner backing portion. Projecting below the inner backing portion of the tray lid are first and second laterally extending ridges 244, 246. The laterally extending ridges are generally parallel to each other and spaced apart from each other such that when the tray lid is placed on the tray, the first laterally extending ridge is disposed in the first track 237 between the upper retaining portion 234 of the peripheral ridge and the first raised stop 236 and the second laterally extending ridge is disposed in the second track 239 between the lower retaining portion 235 of the peripheral ridge and the second raised stop 238. Each laterally extending ridge has an abutment 248 extending outwardly from the inner end of the laterally extending ridge. A cross ridge 250 projects below the inner backing portion 242 and is disposed between the first and second laterally extending ridges 244, 246.

Figure 17:
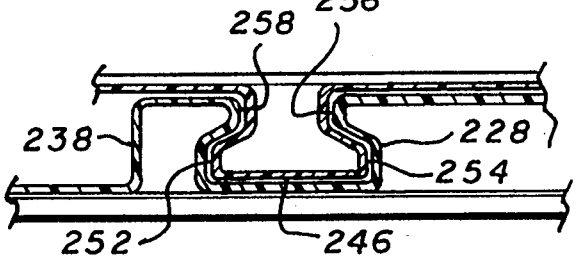
FIG. 17 is a sectional view of the alternative embodiment taken along line 17—17 of FIG. 16.

To stabilize the tray lid with respect to the tray, the laterally extending ridges 244, 246 of the tray lid, the first and second outer walls 226, 228 of the tray, and the first and second raised stops 236, 238 of the tray may all be provided with laterally extending projected portions that interlock the tray lid to the tray. In particular, with reference to FIG. 17, the second laterally extending ridge 246 of the tray lid has a first lower projected portion 252 and a second lower projected portion 254, the second outer wall 228 has an upper projected portion 256 and the second raised stop 238 has an upper projected portion 258. To assemble the tray lid to the tray, the projected portions of the laterally extending ridges are snapped into the tracks 237, 239 of the tray. To assist assembly, the laterally extending ridges may have mounting portions 260 of narrowed width, which make it easier to snap the tray lid into the tracks.

Figure 14:
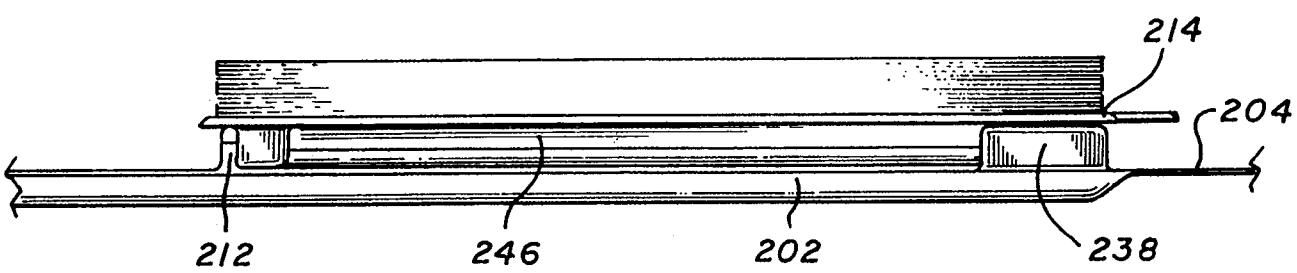
FIG. 14 is an end view of the notebook binder of FIG. 12, as assembled, in the closed position.
Figure 15:
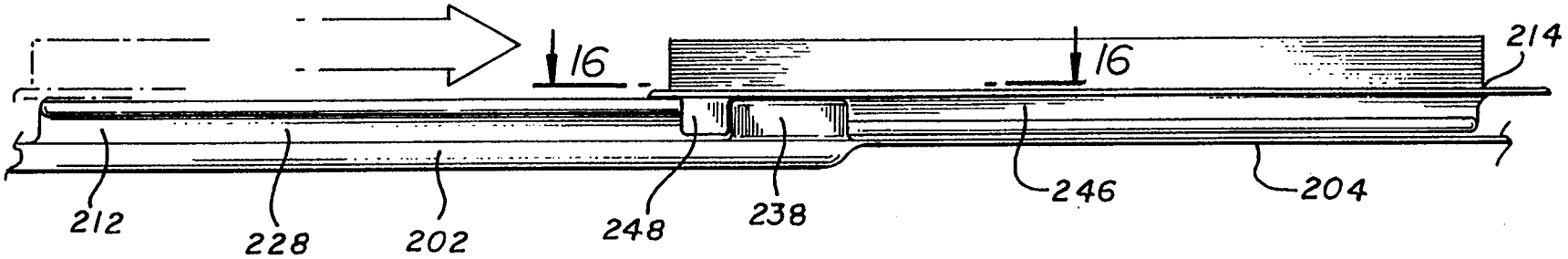
FIG. 15 is an end view of the notebook binder of FIG. 12, as assembled, in the open position.
Figure 16:
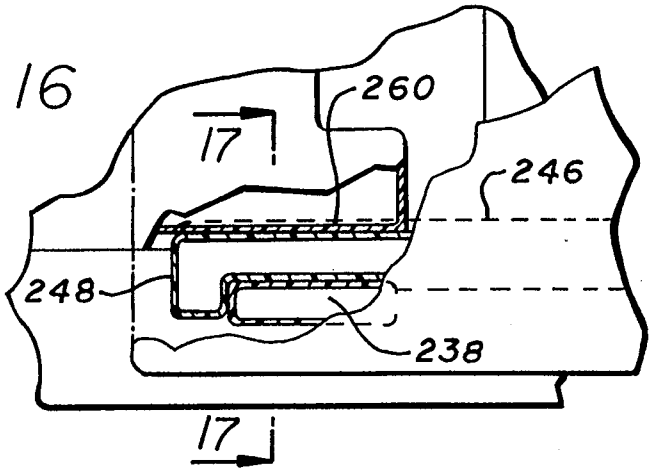
FIG. 16 is a partial plan view, partially in section, of the alternative embodiment, taken along line 16—16 of FIG. 15.

With reference to FIGS. 14–16, the tray lid is slidable along the outer walls 226, 228 of the tray between a closed position, wherein the tray opening is covered (FIG. 14), and a closed position, wherein the tray opening is exposed (FIG. 15). The cross ridge 250 is located on the tray lid such that, in the closed position, it contacts the second sidewall 232 of the tray, preventing further inward sliding movement of the tray lid (see FIG. 12). In the open position, the abutments 248 of the tray lid are disposed against the raised stops 236, 238 of the tray. The depth of the laterally extending ridges 244, 246 and the cross ridge 250 of the tray lid is substantially equal to the height of the peripheral ridge 220 of the tray such that, when the tray lid is attached to the tray, the tray lid is supported on the back cover 202 and on the flexible closure panel 204 of the binder by the laterally extending ridges and the cross ridge.

It should be appreciated from the foregoing description that the present invention provides an improved notebook binder that includes a tray having a sliding lid that acts as a writing surface. The lid is firmly supported to provide a stable writing surface whether the tray opening is covered or uncoveted. The above described tray/lid combination greatly improves the versatility of standard notebook binders. Even though the notebook binder includes the tray, it may still be used for its traditional functions. For example, writing paper may be secured to the ring mechanism and notes may be written thereon even with the paper atop the tray because of the flat surface of the tray lid. A beneficial alternative is that with the tray lid open, a third working surface is provided, i.e., the two surfaces on either side of the ring mechanism and the third surface provided by the opened tray lid. For example, a user may view a full spread of material secured to the ring mechanism and take notes on the extended tray lid. Further, with the tray lid in the opened position, a user may simultaneously access articles in the tray (for example, make calculations on a calculator) and take notes on the flat working surface of the extended tray lid and review notebook materials located on the left hand side of the ring mechanism.

Although the invention has been described in detail with reference only to the preferred embodiments, those having ordinary skill in the art will appreciate that various modifications can be made without departing from the invention. Accordingly, the invention is defined with reference to the following claims.

I claim:

1. A notebook binder for holding articles, comprising:

a binder cover;

a tray fixed to the binder cover and having a peripheral ridge projecting above the binder cover defining a tray opening for receiving articles; and a tray lid having a first portion forming a flat working surface and a second portion in sliding engagement with the tray for permitting sliding movement of the tray lid between a closed position wherein the tray lid covers the tray opening and an extended position wherein the tray lid is adjacent the tray opening with the tray opening uncovered, the second portion further having a support ridge projecting below the flat working surface a sufficient depth to support the flat working surface in a substantially level orientation relative to the binder cover when the tray lid is in the extended position.

2. The notebook binder of claim 1, wherein the peripheral ridge has a first outer wall facing away from the tray opening and a second outer wall facing away from the tray opening in a direction opposite to that of the first outer wall and wherein the second portion of the tray lid has first and second laterally extending ridges projecting below the flat working surface of the lid, the first and second laterally extending ridges configured to oppose the first and second outer walls, respectively, such that the tray lid is laterally slidable along the first and second outer walls between the closed and extended positions.

3. The notebook binder of claim 2, wherein the support ridge is a cross ridge projecting below the flat working surface disposed between the first and second laterally extending ridges.

4. The notebook binder of claim 1, wherein the tray is a first single sheet of plastic material and the second portion of the tray lid is a second single sheet of plastic material.

5. The notebook binder of claim 4, further comprising a tray insert formed in a third single sheet of plastic material, the tray insert having an outer periphery configured to be closely received within the tray opening and defining at least one depressed region for receiving and retaining a selected article.

6. The notebook binder of claim 5, further comprising an article that is securely retained within the depressed region of the tray insert.

7. The notebook binder of claim 6, wherein the tray insert is one of a plurality of interchangeable tray inserts each having an outer periphery that is configured to be closely received with the tray opening.

8. The notebook binder of claim 4, wherein the flat working surface is formed by an outer covering fastened along at least a portion of its periphery to the second sheet of material and a flat rigid insert located between the outer covering and the second sheet of material.

9. The notebook binder of claim 4, wherein the first outer wall of the peripheral ridge has a projected portion that interlocks an opposed projected portion of the first laterally extending ridge of the lid and the second outer wall of the peripheral ridge has a projected portion that interlocks an opposed projected portion of the second laterally extending ridge of the lid.

10. The notebook binder of claim 4, wherein the first single sheet of plastic material defines a first raised stop spaced from and adjacent to the first outer wall to form a first track therebetween and a second raised stop spaced from and adjacent to the second outer wall to form a second track therebetween, the first and second laterally extending ridges being received within said first and second tracks, respectively.

11. The notebook binder of claim 10, wherein the first and second laterally extending ridges each define an abutment for engaging the raised stops to prevent the tray lid from sliding apart from the tray as the tray lid is moved from the closed position to the extended position.

12. The notebook binder of claim 11, further comprising means for preventing the tray lid from sliding off the tray as the tray lid is moved from the extended position to the closed position.

13. The notebook binder of claim 11, further comprising means for preventing the tray lid from being lifted off the tray.

14. The notebook binder of claim 12 wherein the means for preventing the tray lid from sliding off the tray includes a rod holder formed in the first sheet and wherein a rod is mounted between the rod holder and the raised stop and passes through the abutment of the tray lid.

15. The notebook binder of claim 1, wherein the depth of the support ridge is at least substantially equal to the height of the peripheral ridge above the binder cover.

16. The notebook binder of claim 1, wherein the tray lid includes a tab to facilitate sliding movement of the lid by the user.

17. A notebook binder for holding articles, comprising:

a first cover, a second cover and a spine, the first cover hingedly connected along one side of the spine and the second cover hingedly connected along an opposite side of the spine;

a ring assembly mounted to the spine for retaining documentation;

a tray fixed to the second cover and having a peripheral ridge projecting above the second cover defining a tray opening for receiving articles, the peripheral ridge having first and second spaced apart outer walls that are parallel to each other;

a tray lid having a first portion defining a flat working surface and a second portion defining first and second laterally extending ridges projecting below the flat working surface, the second portion also defines a cross ridge projecting below the flat working surface disposed between the first and second laterally extending ridges, the first and second laterally extending ridges configured to oppose the first and second outer walls, respectively, such that the tray lid is laterally slidable along the first and second outer walls between a closed position, wherein the tray lid covers the tray opening, and an extended position, wherein the tray lid is adjacent the tray opening with the tray opening uncovered, the cross ridge of the tray lid having a depth below the flat working surface that is sufficient to support the flat working surface in a substantially level orientation relative to the second cover when the tray lid is in the extended position; and a tray insert having an outer periphery configured to be closely received within the tray opening and defining at least one depressed region for receiving and retaining a selected article.

18. The notebook binder of claim 17, wherein the tray is a first single sheet of plastic material, the first laterally extending ridge, the second laterally extending ridge and the cross ridge are formed in a second single sheet of plastic material and the tray insert is formed in a third single sheet of plastic material.

19. The notebook binder of claim 18, further comprising an article that is securely retained within the depressed region of the tray insert.

20. The notebook binder of claim 19, wherein the tray insert is one of a plurality of interchangeable tray inserts each having an outer periphery that is configured to be closely received with the tray opening.

* * * * *